US011383960B2

(12) United States Patent
Potter et al.

(10) Patent No.: US 11,383,960 B2
(45) Date of Patent: Jul. 12, 2022

(54) DROP TABLE WITH MOTOR FEEDBACK

(71) Applicant: Nabholz Construction Corporation, Conway, AR (US)

(72) Inventors: Mark Raymond Potter, Stratford, CT (US); Stephen Harold Schumacher, Sandy Hook, CT (US)

(73) Assignee: NABHOLZ CONSTRUCTION CORPORATION, Conway, AR (US)

( * ) Notice: Subject to any disclaimer, the term of this patent is extended or adjusted under 35 U.S.C. 154(b) by 213 days.

(21) Appl. No.: 16/459,826

(22) Filed: Jul. 2, 2019

(65) Prior Publication Data

US 2021/0002108 A1 Jan. 7, 2021

(51) Int. Cl.

| | |
|---|---|
| ***B66F 3/08*** | (2006.01) |
| ***B66F 5/00*** | (2006.01) |
| ***B66F 7/06*** | (2006.01) |
| ***B66F 11/04*** | (2006.01) |
| ***B66F 7/20*** | (2006.01) |
| ***B66F 7/02*** | (2006.01) |

(52) U.S. Cl.

CPC ..... *B66F 3/08* (2013.01); *B66F 5/00* (2013.01); *B66F 7/025* (2013.01); *B66F 7/0608* (2013.01); *B66F 7/0616* (2013.01); *B66F 7/20* (2013.01); *B66F 11/04* (2013.01); *B66F 7/0625* (2013.01)

(58) Field of Classification Search

CPC .... B66F 3/08; B66F 7/20; B66F 7/025; B66F 11/04; B66F 5/00; B66F 7/0616; B66F 7/0608; B66F 7/0625; B61K 5/00

See application file for complete search history.

(56) References Cited

U.S. PATENT DOCUMENTS

| | | | |
|---|---|---|---|
| 1,319,833 | A | 10/1919 | Bingaman |
| 1,450,702 | A | 4/1923 | Otis |
| 1,564,828 | A | 12/1925 | Coffey |
| 1,632,256 | A | 6/1927 | Walter |
| 1,707,923 | A | 4/1929 | Phelps |
| 1,773,746 | A | 8/1930 | Nagell |
| 1,802,592 | A | 4/1931 | Christie |
| 1,866,798 | A | 7/1932 | Christie |
| 1,996,618 | A | 4/1935 | Huber |
| 2,097,133 | A | 10/1937 | Richardson |
| 2,178,632 | A | 11/1939 | Holmes |

(Continued)

FOREIGN PATENT DOCUMENTS

| | | |
|---|---|---|
| CN | 205527549 | 8/2016 |
| CN | 207142732 | 8/2018 |

(Continued)

*Primary Examiner* — Mahdi H Nejad

(74) *Attorney, Agent, or Firm* — Hall Estill Law Firm

(57) ABSTRACT

A drop table can provide optimized lifting operations by employing motor feedback to generate and adapt a lifting strategy that controls lifting parameters. A lifting module may be connected to a first motor and consist of a lifting controller. The first motor can be mechanically coupled to a first lifting column by a first transmission and to a second lifting column by a second transmission. A service component can be lowered with the first and second lifting columns by activating the first motor that provides motor feedback. A lifting strategy can be generated in response to the motor feedback and subsequently executed to move the service component to a servicing position.

19 Claims, 4 Drawing Sheets

(56) References Cited

U.S. PATENT DOCUMENTS

| | | | | |
|---|---|---|---|---|
| 2,191,710 | A | 2/1940 | Fones | |
| 2,655,115 | A | 10/1953 | Holdeman et al. | |
| 2,718,851 | A | 9/1955 | Holdeman | |
| 2,800,200 | A | 7/1957 | Wallace | |
| 3,251,311 | A | 5/1966 | Saxonmeyer | |
| 3,472,046 | A | 10/1969 | Potter | |
| 4,015,824 | A | 4/1977 | Profet | |
| 6,244,390 | B1 | 6/2001 | Yeo et al. | |
| 6,863,159 | B2 | 3/2005 | Rauch | |
| 7,198,135 | B2 | 4/2007 | Naber | |
| 7,900,562 | B2 | 3/2011 | Esposti et al. | |
| 7,954,602 | B2 | 6/2011 | Stanislao | |
| 8,028,973 | B2 | 10/2011 | Ford et al. | |
| 8,083,034 | B2 | 12/2011 | Bordwell et al. | |
| 8,251,184 | B2 | 8/2012 | De Jong | |
| 8,286,754 | B2 | 10/2012 | Cohn | |
| 8,397,643 | B2 | 3/2013 | Esposti et al. | |
| 8,567,761 | B2 | 10/2013 | De Jong et al. | |
| 8,919,476 | B2 | 12/2014 | Holland et al. | |
| 8,939,296 | B2 | 1/2015 | Weyler et al. | |
| 9,045,149 | B2 | 6/2015 | Knapp et al. | |
| 9,073,558 | B2 | 7/2015 | Knapp et al. | |
| 9,126,607 | B2 | 9/2015 | Knapp et al. | |
| 9,193,572 | B2 | 11/2015 | Finkbeiner et al. | |
| 9,267,258 | B2 | 2/2016 | Knapp et al. | |
| 9,295,324 | B2 | 3/2016 | Knapp et al. | |
| 9,758,359 | B2 | 9/2017 | Kamphuis et al. | |
| 9,764,933 | B2 | 9/2017 | Knapp et al. | |
| 9,764,934 | B2 | 9/2017 | Knapp et al. | |
| 9,970,325 | B2 | 5/2018 | Oden et al. | |
| 10,000,221 | B2 | 6/2018 | Knapp et al. | |
| 2008/0202286 | A1* | 8/2008 | Brechelente | B23Q 5/408 74/841 |
| 2012/0193590 | A1* | 8/2012 | Horwath | B66F 7/14 254/92 |
| 2015/0166313 | A1* | 6/2015 | Knapp | B66F 7/10 254/89 R |
| 2015/0166315 | A1* | 6/2015 | Knapp | B66F 1/06 700/213 |
| 2016/0039646 | A1* | 2/2016 | Knapp | B66F 3/46 254/89 R |
| 2021/0309499 | A1* | 10/2021 | Elliott | B66F 7/025 |

FOREIGN PATENT DOCUMENTS

| | | | |
|---|---|---|---|
| FR | 2388178 | A1 * | 11/1978 |
| JP | 62-041464 | A | 2/1987 |

* cited by examiner

DROP TABLE WITH MOTOR FEEDBACK

SUMMARY

A drop table has, in accordance with some embodiments, a lifting module is connected to a first motor and has a lifting controller. The first motor is mechanically coupled to a first lifting column by a first transmission and to a second lifting column by a second transmission with the lifting controller configured to generate a lifting strategy in response to feedback from the first motor.

In other embodiments, a drop table consists of a lifting module that employs a lifting controller to generate a lifting strategy in response to motor feedback received during vertical movement of a service component by first and second lifting columns connected to the lifting module.

Operation of a drop table, in some embodiments, involves lifting module connected to a first motor and consist of a lifting controller. The first motor is mechanically coupled to a first lifting column by a first transmission and to a second lifting column by a second transmission. A service component is lowered with the first and second lifting columns by activating the first motor that provides motor feedback. A lifting strategy is generated in response to the motor feedback and subsequently executed to move the service component to a servicing position.

DETAILED DESCRIPTION

Embodiments of a drop table are generally directed to structure and methods of utilizing motor feedback to optimize lifting operations conducted by a drop table as part of a maintenance system.

For years, machinery has needed maintenance to properly and safely operate. Machinery that provide transportation services, such as trucks, locomotives, and buses, can be particularly susceptible to degraded performance as a result of deferred maintenance. Hence, the efficiency, safety, and reliability of transportation machinery has a direct correlation with the efficiency and reliability of maintenance equipment.

For transportation machinery that consistently handles relatively large numbers of people, the moving components that provide propulsion and suspension can have a frequent maintenance schedule. Such components can be quite large, heavy, and cumbersome compared to other machinery aspects that require routine maintenance. Maintenance equipment capable of handling large, heavy, and cumbersome components have traditionally been rather crude, inefficient, and prone to dangerous failures. For instance, equipment capable of lifting and moving fifty tons or more can be powerful and robust, but experience degraded performance that is not easily identifiable until a failure.

Accordingly, a maintenance system is configured, in some embodiments, with a drop table that intelligently utilizes motor feedback to generate a lifting strategy that increases the efficiency, safety, and reliability of lifting operations, particularly in operations involving large, heavy, or cumbersome machinery components. By generating a lifting strategy from motor feedback, a drop table can quickly adapt to encountered operational parameters to provide optimal safety and performance. The closed-loop control of a drop table allowed by monitoring motor feedback provides efficient detection of lifting conditions and verification that altered lifting parameters result in improved lifting performance.

Figure 1:
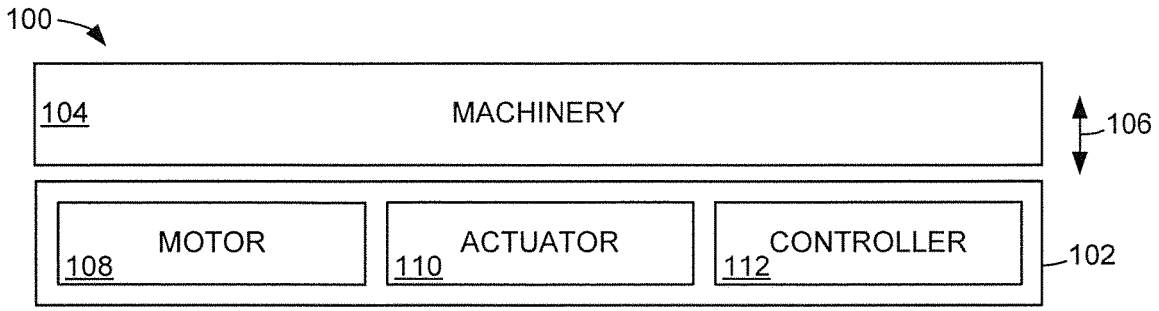
FIG. 1 is a block representation of an example maintenance system in which various embodiments can be practiced.

An example maintenance system 100 is depicted in FIG. 1. The block representation of the maintenance system 100 displays a lifting mechanism 102 that can engage machinery 104 to conduct maintenance operations. The lifting mechanism 106 can be configured to service any type, and size, of machinery 104, such as a locomotive, bus, railcar, or semi-truck. It is contemplated that multiple separate pieces of machinery 104 can concurrently be accessed and serviced by the lifting mechanism 102 to provide vertical movement 106, but such arrangement is not required or limiting.

The lifting mechanism 102 can consist of at least a motor 108, or engine, that allows one or more actuators 110 to physically engage and move at least one machinery component. A local controller 112 can direct motor 108 and actuator 110 operation and may be complemented with one or more manual inputs, such as a switch, button, or graphical user interface (GUI), that allow customized movement of the machinery component. The local controller 112 can conduct a predetermined lifting protocol that dictates the assorted forces utilized by the motor 108 and actuator 110 to efficiently and safely conduct vertical component displacement.

Figure 2:
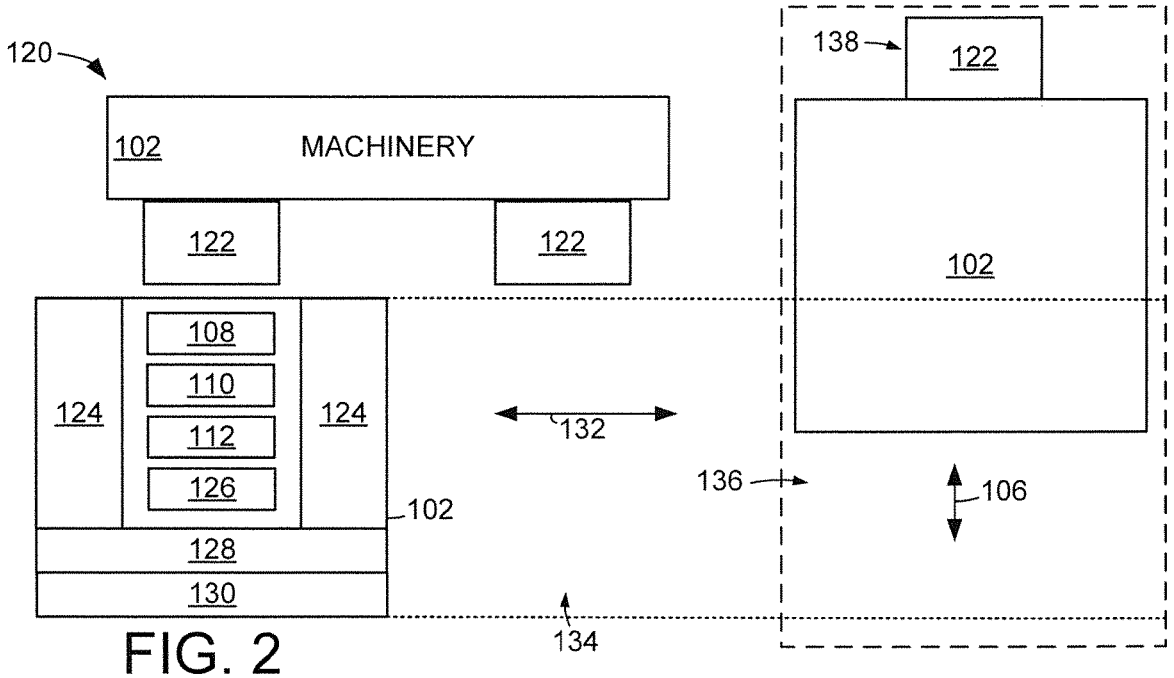
FIG. 2 depicts a block representation of an example drop table system arranged in accordance with various embodiments.

FIG. 2 depicts a block representation of an example lifting system 120 arranged to provide maintenance operations for machinery 104. A lifting mechanism 102 can consist of one or more motors 108, actuators 110, and controllers 112 that are utilized to engage and secure a machinery component 122, such as a wheel, suspension, engine, or body, throughout a range of vertical motion 106. Depending on the position and size of the component 122, the lifting mechanism 102 can vertically manipulate the component 122 itself or the machinery 104 as a whole to allow efficient access, removal, and subsequent installation of the component 122 to be serviced.

Although assorted maintenance can be facilitated without physically moving the machinery 104, such as engine tuning or joint greasing, other maintenance requires the separation of one or more components from the vehicle 102. Such separation can be conducted either by lifting the machinery 104 while a component 122 remains stationary or by lowering the component 122 while the machinery 104 remains stationary. Due to the significant weight and overall size of some machinery 104, such as a locomotive engine or railcar, the lifting system 120 is directed in some embodiments to moving a component 122 vertically while the remainder of the machinery 104 remains stationary.

It is contemplated that the lifting mechanism 102 can consist of one or more lifting columns 124 that operate collectively to vertically displace a component 122. In some embodiments, multiple separate lifting columns 124 each raise a platform 126, as shown in FIG. 2. That is, lifting columns 124 that are physically separated can be concurrently activated to apply force on a platform 126 that physically supports the component 122. Such unified lifting column 124 and platform 126 can provide consistent operation over time as deviations in operating characteristics, such as lifting speed and precision, are mitigated by the platform 126 that physically brings the respective lifting columns 124 into similar operating characteristics. However, the use of a unifying platform 126 can make the lifting mechanism 102 rather large and physically restrictive to machinery 104 and/or components 122 of certain sizes and shapes.

Other embodiments configure the lifting mechanism 102 of multiple separate lifting columns 124 that each contact different portions of a component 122 via independent protrusions 128. The use of independent lifting columns 124 can provide increased physical compatibility with diverse machinery 102 and/or component 122 shapes and sized. In yet, independent lifting columns 124 can be more susceptible to component 124 instability during lifting operations as a result of deviations in operating characteristics for the respective columns 124. Such independent lifting column 124 configuration also suffers from increased complexity compared to using a unifying platform 126 due to the coordination of the respective column's 124 operation to provide secure component 122 movement.

It is contemplated that a lifting column 124 can be secured to a base 128, such as a floor, foundation, or frame. A base 128 can be constructed to be permanently stationary or move upon activation to relocate the collective lifting columns 124. The rigid connection of each lifting column 124 to a base 128 can provide increased strength to the lifting mechanism 102, but can limit the operational flexibility of the system 120. Conversely, the respective lifting columns 124 can have transport assemblies 130, such as a suspension, wheels, or tracks, that allow a column 124 to move relative to a base 128 via manual or automated manipulation.

In accordance with some embodiments, the lifting mechanism 102 can be characterized as a drop table onto which the machinery 104 moves to position a component in place to enable component removal, and subsequent installation. A drop table can be configured to facilitated vertical component movement 106 as well as horizontal movement, as represented by arrows 132. The relatively large size of many components 122 is accommodated by positioning the drop table lifting mechanism 102 in a shaft 134, which may be positioned underground, to allow efficient horizontal movement 132 to a service shaft 136 that is vertically traveled to position the component 122 in a servicing position 138 away from the machinery 104.

With the combination of vertical component movement 106 and horizontal component movement 132, a drop table lifting mechanism 102 can experience a broad range of forces that jeopardize system 120 operation and safety. That is, a drop table 102 can encounter differing forces from diverse vectors during the lowering, horizontal translation, and raising of a component 122 that has a substantial weight, such as 10 tons or more, which may place a diverse variety of strain on at least the moving aspects of the drop table 102. Hence, the range of movement of the drop table 102 has a greater risk of part failure and safety hazards compared to lifting mechanisms simply employed for vertical movement 106.

Figure 3A:
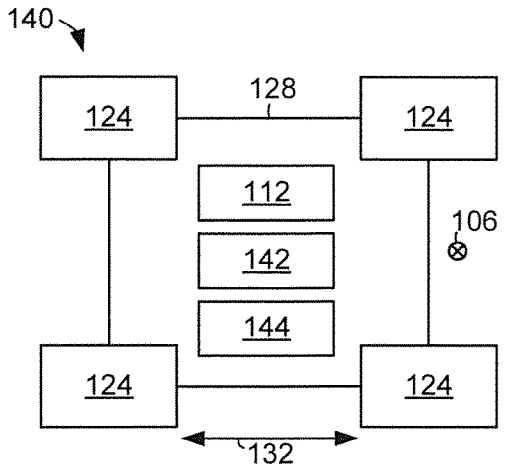
FIGS. 3A & 3B represents portions of an example drop table capable of being used in the systems of FIGS. 1 & 2.
Figure 3B:
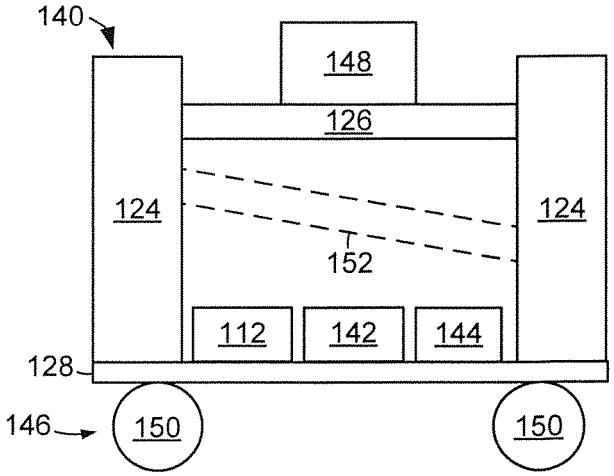

FIGS. 3A & 3B respectively depict block representations of portions of an example lifting system 140 that can be employed as part of a maintenance system 100. The top view of FIG. 3A displays a platform 126 disposed between and physically attached to multiple lifting columns 124. As directed by a local controller 112, one or more lifting motors 142, or engines, can articulate aspects of the respective columns 124 to move the platform 126 in the vertical direction 106. The controller 112 may further direct one or more transverse motors 144, or engines, to activate a drive line 146 and move the platform 126 along the horizontal direction 134.

It is contemplated that one or more lifting columns 124 are physically separated from the platform 126, but such configuration would necessitate individual motors 142/144 for each column 124 along with complex spatial sensing and coordination to ensure a load 148 is securely lifted and moved. Instead, the platform 126 physically unifies the respective lifting columns 124 and provides a foundation onto which the load 148 can rest and provide a consistent center of gravity throughout lifting 106 and horizontal 132 movement activities.

FIG. 3B displays side view and an example physical layout of the lifting system 140 where a base 128 remains stationary while the platform 126 is vertically translated. The base 128 provides a secure foundation for the various motors 142/144 and associated transmission to the respective lifting columns 124. The base 128 further anchors the drive line 146 and number of constituent rollers 150, which can be wheels, castors, trucks, or other assembly utilizing a bearing. During normal operation, the assorted lifting columns 124 provide uniform platform 126 lifting and lowering.

However, the fact that the multiple lifting columns 124 can independently experience failures increases the operational risk of less than all of the columns 124 experiencing an error. When a lifting column 124 experiences a failure while other columns 124 continue to operate, the platform 126 can become unstable, as illustrated by segmented platform 152, and the very heavy load 148 can be at risk of damage and/or damaging the lifting system 140 as well as nearby equipment and users. Hence, the use of independent lifting motors 142, or independent lifting columns 124 separate from a platform 126, can be particularly dangerous. Furthermore, independent lifting columns 124 provide less physical space for motors 142 and limit the available motor size and power that can be safely handled by a column 124, which reduces the efficiency and safety of lifting heavy loads 148 safely, such as over 10 tons.

In contrast to independent lifting columns 124 having independent lifting motors 142, it is contemplated that a single motor can be employed to power the respective columns 124 collectively. While the base 128 could provide enough space and rigidity to handle a single motor/engine 142, the failure rates and operational longevity of a motor/engine 142 capable of lifting a load 148 weighing tens of tons can involve increased service times and frequency that can be prohibitive in terms of lifting system 140 operational efficiency. In addition, it is noted that large parasitic energy losses can be experienced through transmission that translates the power output of a single motor/engine 142 to four separate lifting columns 124.

Accordingly, various embodiments configure a drop table lifting mechanism 102 with two separate variable speed, dual drive lifting motors 142 each powering two separate lifting columns 124 that are unified by a single platform that is vertically manipulated by the collective operation of the lifting columns 124 and dual drive motors 142. The combination of two lifting motors 142 to power four columns 124 provides an enhanced motor efficiency via relatively simple transmissions, lower service times/frequency, and relatively simple motor 142 coordination compared to independent columns 124 or a single motor powering four columns 124.

Figure 4A:
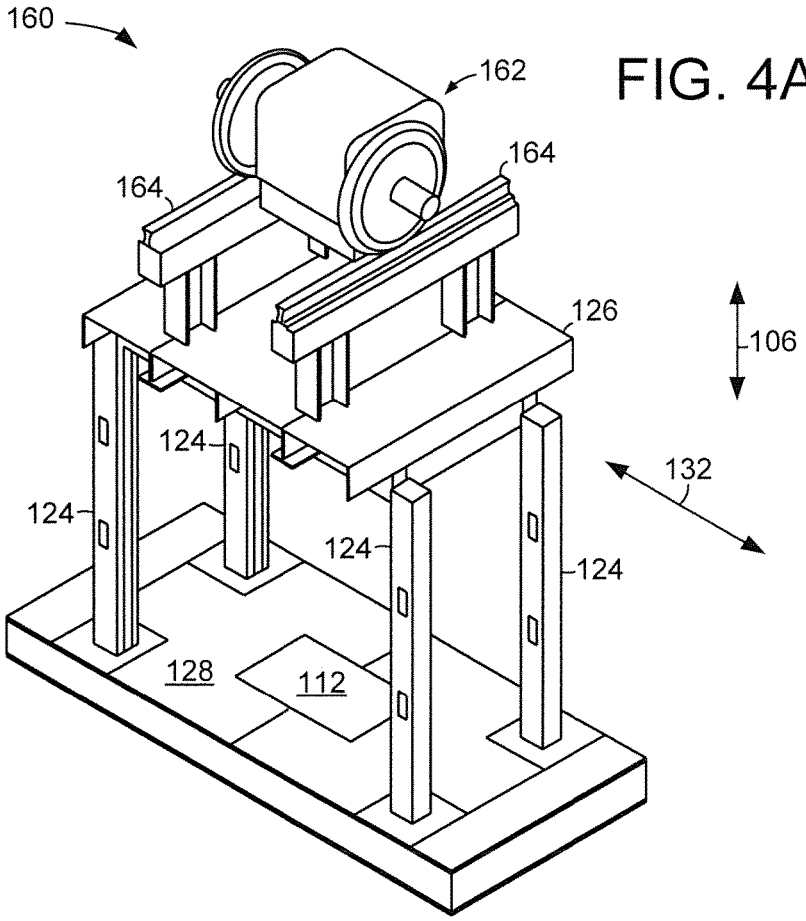
FIGS. 4A-4C depict portions of an example drop table configured in accordance with assorted embodiments.
Figure 4B:
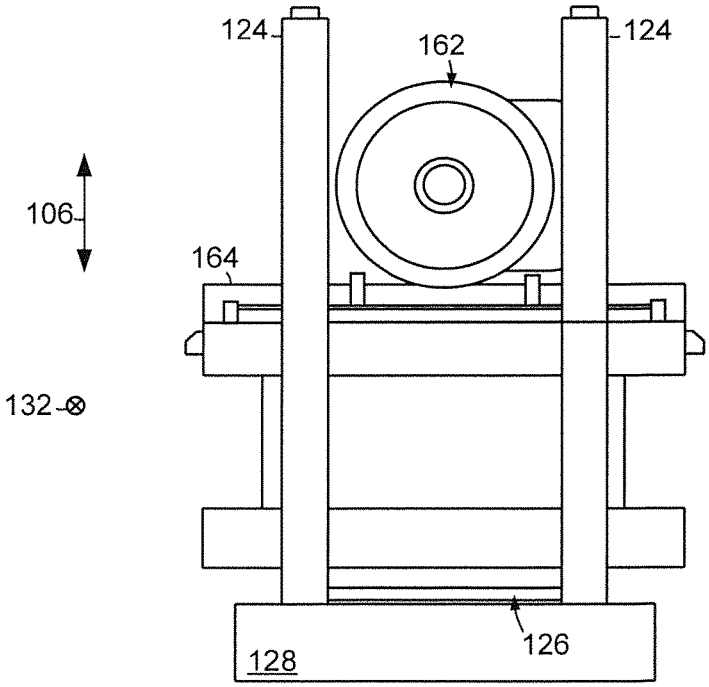
Figure 4C:
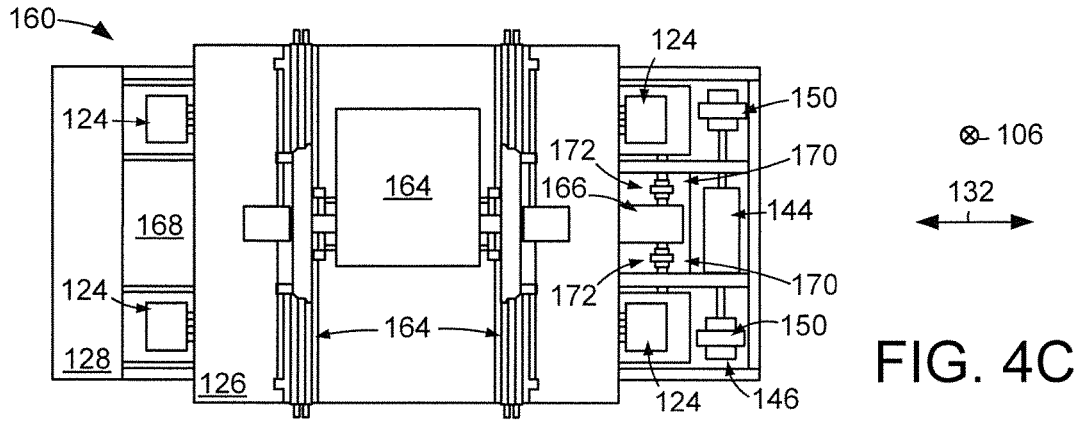

FIGS. 4A-4C respectively depict portions of an example drop table 160 that can be utilized in a maintenance system in accordance with some embodiments. FIG. 4A is a perspective view line representation of a locomotive component 162 resting on rail segments 164 that are supported by a platform 126. The platform 126 is attached to four lifting columns 124 that extend from a common base 128. In FIG. 4A, the platform 126 is in an elevated position as directed by a lifting controller 112 activating the respective lifting columns 124 to provide consistent vertical displacement without shock or disorientation of the platform 126.

During operation, the lifting controller 112 activates and controls the respective lifting columns 124 to maintain a uniform lifting speed in the vertical direction 106 from a bottom position, as shown in the side view of FIG. 4B, to the elevated position without the platform 126 experiencing any tilt, pitch, or roll dynamics that can move the center of gravity of the platform 126 and jeopardize the lifting integrity of the component 162. In other words, the lifting controller 112 can carry out matching, or different, lifting operations with the respective lifting columns 124 to ensure the platform 126 remains level, which can be characterized a parallel to the horizontal X-Y plane, throughout the vertical displacement.

The base 128 may be constructed to contain a pair of variable drive motors 166 that each are mechanically coupled to two lifting columns 124. As shown in FIG. 4C where a cover 168 of the base 128 is removed, a variable drive motor 166 can be disposed between two lifting columns 124 and connected to each lifting column 124 via a transmission 170 that features at least one shearing coupling 172. The shearing couplings 172 can provide added safety to lifting operations by failing in response to experienced force above a predetermined threshold. As a result of the shearing couplings 172, mechanical failures can be isolated to the respective transmissions 170 of the drop table 160 instead of causing motor failures 166. The exposed portion of the base 128 in FIG. 4C also shows how a transverse motor 144 can positioned to drive a pair of wheels of a drive line 130.

The use of variable drive motors 166 allows for intelligent operation and enhanced safety compared to fixed speed motors or engines. By utilizing a variable speed, or variable frequency, motor 166, the drop table can detect lifting parameters without human or electric input. In some embodiments, the monitoring of motor 166 electric consumption and frequency variations during operation can be characterized as motor feedback. For instance, a lifting controller 112 can monitor motor feedback of the respective motors 166 to determine the lifting speed of a platform and the lifting behavior of the respective columns 124.

As a non-limiting example, increased electric consumption, or deviations in motor frequency, for one output shaft of a motor 166 can be compared to a default consumption/frequency and to the consumption/frequency of the other output shaft of the motor 166 to indicate a lifting error has occurred or is occurring. The ability for a controller 112 to identify errors, failures, and proper lifting operation allows for closed-loop control within the drop table 160 that can adapt to detected conditions to optimize the efficiency and safety of lifting with optimal column 124 longevity.

The use of motor feedback for drop table operation status alleviates the reliance on external sensors and/or user input for operational parameter detection, which increases the responsiveness of the controller 112 and effectiveness of operational adaptations choreographed by the controller 112. While external sensors, such as acoustic, environmental, and optical type detection mechanisms, can be employed to provide data to the controller 112 that enables intelligent lifting column 124 operation, the closed-loop motor feedback detection of lifting operations is less vulnerable to sensor failure or false readings. That is, motor feedback provides actual lifting conditions that do not provide false readings and cannot fail unless the motor itself fails, which would in itself be feedback that prompts the controller 112 to deactivate the other motor 166 of the drop table.

Figure 5A:
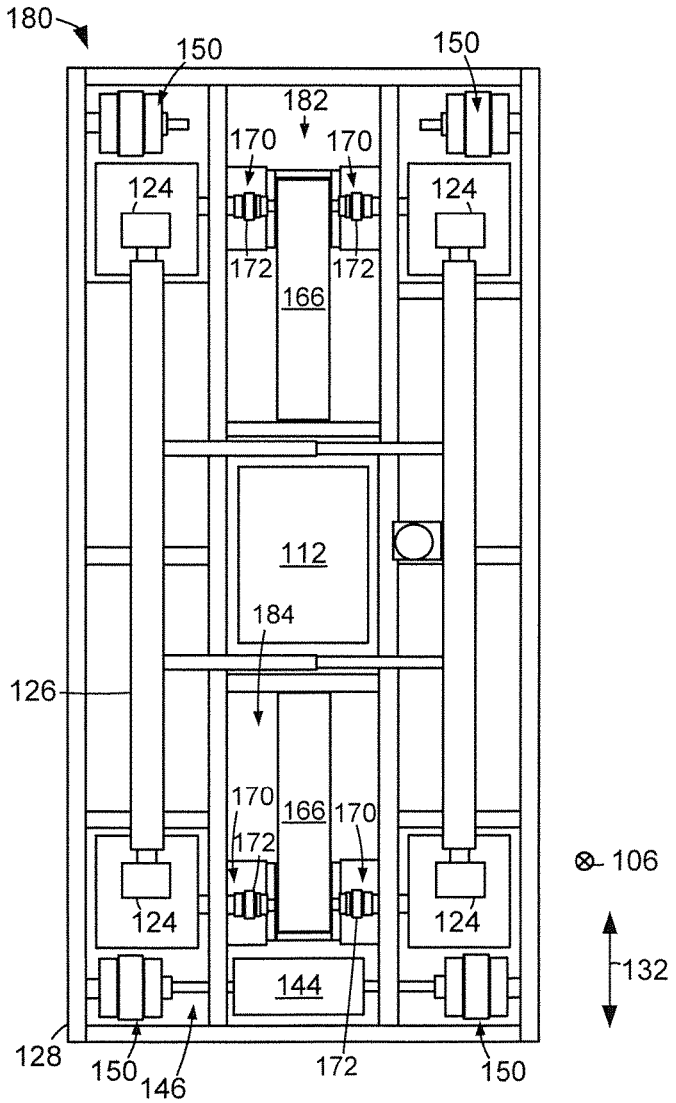
FIGS. 5A & 5B respectively depict portions of an example drop table capable of being employed in the systems of FIGS. 1 & 2.
Figure 5B:
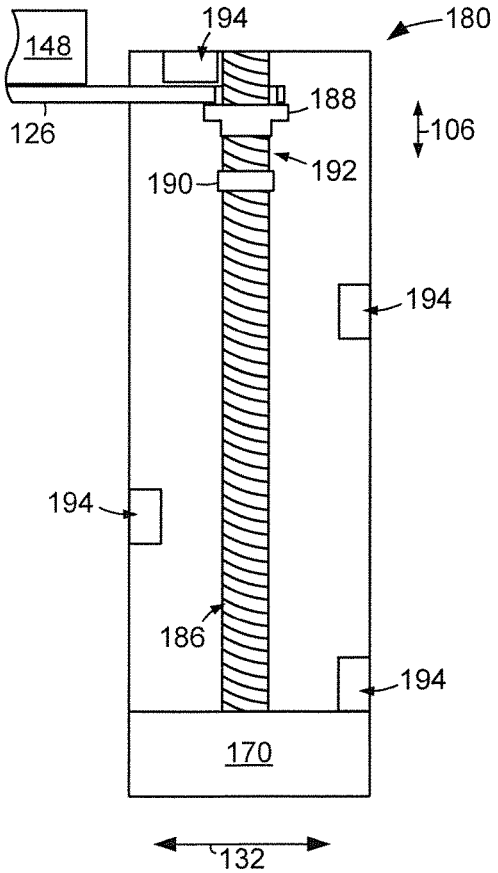

FIGS. 5A & 5B respectively depict portions of another example drop table 180 arranged in accordance with various embodiments to utilize motor feedback to provide lifting operations optimized to the actual performance of the drop table 180. The top view of FIG. 5A shows the drop table base 128 housing a pair of separate lifting mechanisms 182 and 184. Each mechanism 182/184 has a variable drive motor 166 that powers two separate lifting columns 124 via separate transmissions 170.

While a single transmission 170 may be used to power two lifting columns 124, such configuration can be a source of mechanical degradation and failure over time, particularly when tens of tons of components 122 are cyclically raised and lowered. Accordingly, the drop table 180 has separate transmissions 170 that respectively extend from an output shaft of the motor 182/184 to a single lifting column 124. As shown by the view of FIG. 5B, each transmission 170 interacts with a threaded core 186 of a lifting column 124 to induce core 186 rotation and vertical displacement of a traveler 188 and connected platform 126.

The traveler 188 is prevented from failing and failing down the core 186 by at least one safety nut 190 that vertically moves along the core 186 at a predetermined separation from the traveler 188. The nut gap distance between the nut 190 and traveler 188 can be monitored by one or more sensors continuously extending through the nut 190 to access the nut gap 192. The accurate and real-time sensing of the nut gap 192 can supplement the monitored motor feedback to allow a controller 112 to identify the operational parameters of the lifting columns 124. For example, the nut gap sensor measurements can be used to verify motor feedback data and to identify a traveler 188 as faulty, degraded, or otherwise in need of service or replacement.

FIG. 5B further depicts a number of other sensors 194 that can be used independently and collectively to provide a lifting controller 112 with data that supplements motor feedback data. Although the mechanical configuration of the traveler 188 and nut 190 on the core 186 can be operated at will and manually inspected at any time, it is noted that may operational defects and degraded performance occur while the core 186 is rotating and the traveler/nut are moving, which is dangerous to manually inspect. Hence, one or more sensors 194 can be positioned inside, or outside, the column housing 196 to monitor one or more operational characteristics of the lifting column 124 without any danger to a user.

Various embodiments can utilize any number of sensors 124 of one or more type to detect operational conditions associated with traveler 188 and nut 190 vertical manipulation. As a non-limiting example, acoustic, optical, mechanical, and environmental sensors can be placed throughout the housing 196 to measure the operating parameters associated with lifting, and lowering, such a temperature, humidity, moisture content, rotational speed, distance from the top of the core 186, distance to the bottom of the core 186, stress, tension, cracks, plastic deformation, and dimensions of the core 186 threads.

With the nearly unlimited sensor 194 configuration possibilities for a lifting column 124, operation can be closely monitored and collected data can be used to alter core 186 operation, such as rotation speed, and/or schedule service actions that can proactively, or reactively, ensure safe, reliable, and consistent future lifting column 124 operation. One measurement that would optimize the sensing of lifting column 124 operation is the nut gap distance between the nut 190 and traveler 188. However, the typically small nut gap 192 (<1 inch) is difficult to accurately sense. That is, a small nut gap 192 distance creates difficulties in positioning a sensor 194 within, or proximal to, the nut gap 192 to accurately provide real-time operational measurements, particularly with the heat, stress, and presence of grease in the nut gap 192 during operation.

Figure 6:
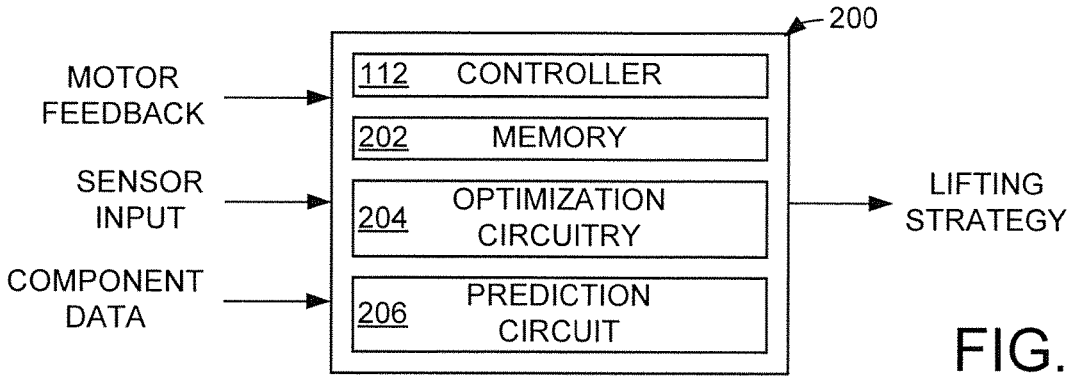
FIG. 6 depicts an example lifting module that can be utilized by a drop table as part of a maintenance system.

FIG. 6 depicts a block representation of an example lifting module 200 that can be utilized by a lifting controller 112 to provide intelligent lifting operations for a drop table as part of a maintenance system. The module 200 can be circuitry resident in a programmable processor, microcontroller, or other logic circuit that can generate an intelligent lifting strategy in response to assorted data from aspects of a drop table. The module 200 can employ some, or all, of a lifting controller 112 to log the operational characteristics of a drop table to discern the optimal operating parameters to provide efficient, safe, and reliable vertical displacement of a load, as defined in the lifting strategy.

The lifting controller 112 can selectively store at least input drop table data, lifting strategies, and other operational parameters in a memory 202, such as a volatile or non-volatile data storage device like a hard disk drive or solid-state array. The lifting controller 112 can monitor motor feedback from each variable drive motor of a drop table in order to determine the quality and integrity of lifting operations in each lifting column. While not required or limiting, the motor feedback data may be supplemented with information collected from one or more sensors that is used to verify the motor feedback data as well as identify other lifting parameters.

For instance, an acoustic sensor can be used to collect friction information and/or information about how a load is positioned on a drop table platform, which allows the lifting controller 112 to determine the center of gravity for the platform. As another example, a mechanical sensor can be used to collect nut gap distance information that can be correlated by the controller 112 to efficiency and longevity of a lifting column traveler. One or more environmental sensors may additionally be used to provide the controller 112 with information about the operating conditions around a drop table, such as temperature and humidity, that can be used to determine at least motor, transmission, and rotating core efficiencies.

It is contemplated that lifting data can be manually input, or downloaded, to the lifting module 200 by a user. Manually inputted information about the load/component being lifted, such as weight, dimensions, and center of gravity, can allow the lifting controller 112 to identify potential hazards during a maintenance operation involving the raising, lowering, and horizontal displacement of the load/component. For example, the lifting controller 112 may correlate a particularly heavy load with increased strain on a transmission or a load with an odd shape and a center of gravity offset from the center of the lifting platform with increased strain on a particular lifting column.

While the collection of information and determination of various lifting conditions by the lifting controller 112 can be informative, the value of the lifting strategy is the optimization of lifting conditions for a variety of different hypothetical situations. That is, the lifting controller 112 can identify current conditions based on inputted data, but may not be equipped alone to correlate the current conditions with different possible lifting situations, such as if a shearing coupling fails, a lifting column seizes, or a load moves. Hence, the lifting module 200 can utilize an optimization circuit 204 that evaluates possible future lifting conditions against the current lifting conditions identified by the controller 112.

It is noted that the optimization circuitry 204 and lifting controller 112 can concurrently operate during drop table operation to adapt a lifting strategy to changing drop table, load, and environmental conditions, which provides maximum operational efficiency and nearly immediate reaction to deviations to prescribed lifting parameters. The optimization circuitry 204 can function alone or in combination with a prediction circuit 206 to provide lifting strategy activities that will provide optimal lifting performance and safety for a diverse variety of encountered lifting condition changes.

The prediction circuit 206 can utilize one or different techniques to accurately forecast future lifting conditions as well as forecast the most likely deviations from those future conditions. One such technique can involve comparing current lifting conditions identified by the controller 112 with previously logged lifting conditions with the drop table. Another possible technique can involve using model data from a database generated from other drop table operations, such as from a drop table manufacturer. It is contemplated that the more lifting operations that are conducted by a drop table will improve the accuracy and breadth of the prediction circuit 206 as encountered operational deviations from a lifting strategy are identified and managed by the lifting module 200.

With the prediction circuit 206 providing different lifting conditions that accurately reflect future parameters of a drop table, the optimization circuitry 204 can generate reactive actions that correct, or at least mitigate any performance, safety, and long-term reliability degradation that those future lifting parameters can cause. For instance, the prediction circuit 206 may forecast the performance degradation of a single lifting column and the optimization circuitry 204 can build the lifting strategy with one or more proactive and reactive actions, such as increased grease pressure, slower lifting speed, or movement of the load relative to the platform, that can be triggered by the lifting controller 112 in response to identified lifting conditions, such as lifting at a certain height or when motor feedback reaches a certain amperage/frequency.

Figure 7:
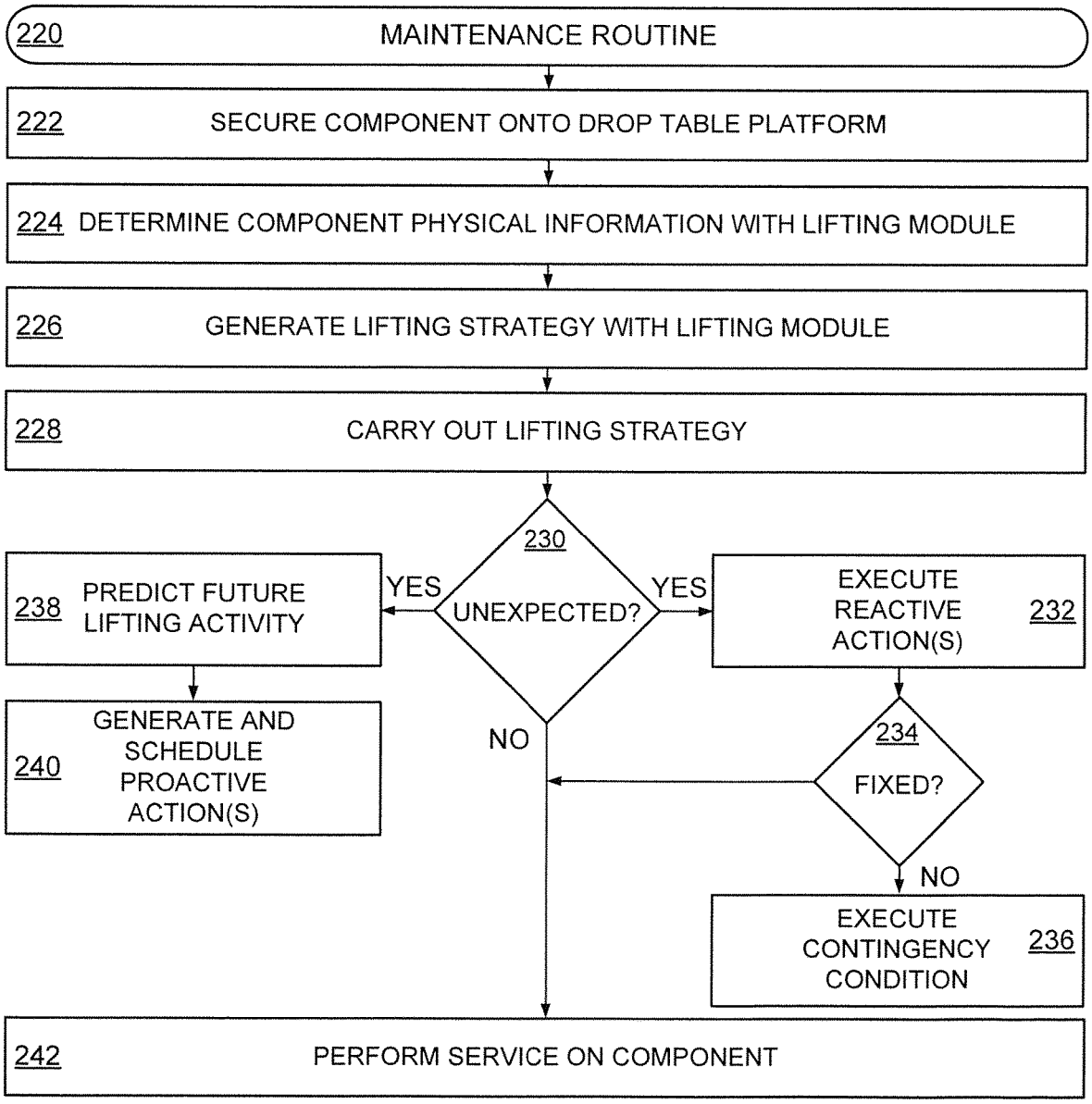
FIG. 7 is an example maintenance routine that may be executed with assorted embodiments of FIGS. 1-6.

FIG. 7 conveys an example maintenance routine 220 that can be carried out with at least a drop table that employs the lifting module 200 of FIG. 6 in accordance with various embodiments. Initially, the routine 220 provides a drop table that can access a loading region under machinery, such as a locomotive or railcar, and a servicing region at the top of a service shaft, as generally depicted in FIG. 2. It is contemplated, but not required, that the drop table has four lifting columns powered by two variable drive motors and independent transmissions each featuring a shearing drive coupling.

Step 222 utilizes the drop table to load a component onto a raised platform while the machinery is securely stabilized. For instance, a locomotive can drive over a drop table and be secured as a rail truck portion of the locomotive is physically attached to rail segments supported by the drop table platform, as generally shown in FIG. 4A. It is contemplated that information about the component to be moved by the drop table is inputted, or downloaded, by a user to a lifting controller of a lifting module.

Such manual inputting of data can be helpful to generate a lifting strategy, but is not required as step 224 can discern pertinent information about the component being moved from at least monitored motor feedback. In other words, the lifting module can determine assorted component information, such as weight and center of gravity, from monitored motor feedback from the respective variable drive motors. Step 224 may additionally involve one or more sensors, such as an optical or acoustic type sensor, providing information about the component loaded onto the drop table platform.

Regardless of the detection means for providing the lifting module with component information, the module utilizes the provided information to generate a lifting strategy in step 226. It is noted that a default lifting strategy that is agnostic to component size, weight, and center of gravity may be initially present during component data acquisition and drop table operation. In yet, the lifting strategy generated in step 226 directly relates to the component being moved and to the operational characteristics of the drop table itself. That is, the lifting controller employs the optimization circuitry and prediction circuit of the lifting module to translate any manually inputted component information with automatically inputted component information to identify the component physical characteristics that pertain to lifting operations and correlate those characteristics with the condition of the lifting columns, drive motors, and transmissions of the drop table in the form of a lifting strategy that prescribes several different motor operations in response to predicted operating parameters.

Therefore, the result of step 226 is a lifting strategy customized to the past operating performance of the drop table and the component being moved while providing automatic reactive actions that can correct, or mitigate, deviations from the lifting strategy. As an example, the lifting strategy can provide a closed-loop system that initially prescribes a uniform amperage for each drive motor of the drop table and at least one reaction to a predicted spike in motor amperage that saves the respective motors from failing in the event that spike occurs.

The newly customized lifting strategy is then carried out in step 228 to lower the component into a maintenance shaft and subsequently traverse that shaft in route to a servicing position at the top of a service shaft that intersects the maintenance shaft. The horizontal and vertical manipulation of the component with the drop table is continuously monitored by decision 230 to determine if the operational lifting parameters are following the parameters prescribed by the lifting strategy generated in step 226. In other words, decision 230 evaluates if the drop table is operating, and the component is moving, in a nominal manner that corresponds with past drop table operation, which indicates no errors, failures, or new issues have arisen. Such evaluation of decision 230 may involve strictly the motor feedback from each variable drive motor or may incorporate measurements from one or more sensors that can be used to validate and/or complement the motor feedback data.

If decision 230 discovers a deviation from the lifting strategy has occurred, or is imminent based on a sequence of events predicted by the lifting module, step 232 is triggered to execute one or more reactive actions prescribed by the lifting strategy to correct or mitigate the performance and safety operation of the drop table. It is contemplated that a lifting strategy deviation is encountered that is not predicted or correctable by reactive actions of the lifting strategy. Thus, decision 234 determines if the action(s) of step 232 actually fix the deviation discovered in decision 230. Such deviation fixing may either eliminate the deviation or progress the deviation towards nominal operating parameters defined by the lifting strategy.

A fixed deviation from the lifting strategy returns routine 220 to decision 230 where the lifting strategy remains in use. If the reactive action(s) of step 232 do not fix, or progress, the deviation, step 236 executes a lifting strategy contingency condition where drop table maintenance is scheduled and maintenance actions are prescribed, such as lubricating a traveler or replacing a shearing coupling. Step 236 may or may not finish the lifting operations associated with servicing the component depending on the severity of risk to performance and safety based on the encountered deviation.

While lifting operations can reactively be optimized through the operational adaptations allowed by the lifting strategy that utilizes intelligent actions to correct, or mitigate, deviations from normal, default, and expected lifting parameters, the ability to proactively prevent deviations in lifting parameters provides a drop table with long-term reliability and safety. The detection of actual operational parameters that deviate from expected lifting conditions in decision 230 may also trigger the lifting module to predict future lifting behavior in step 238 based on the detected lifting behavior of the drop table and future lifting activity predicted by the lifting module in response to the detected behavior.

For example, a deviation from expected motor feedback at a particular location on a rotating core can be used to predict future greater deviations and identity the lifting column core as degraded. As another non-limiting example, a sensed nut gap deviation can be used to predict future motor feedback deviations corresponding with traveler damage that will increase at a known rate, such as linear or exponential.

The ability to predict future lifting parameters with accuracy due to the intelligence of the lifting module and the basis of the lifting strategy allows proactive actions to be efficiently generated and scheduled in step 240. Such proactive actions can be conducted in the future to prevent at least one predicted behavior. For instance but in no way required or limiting, grease can be scheduled to be removed from a lifting column core, a traveler can be physically reinforced, or certain portions of a core can be treated with greater, or lesser, lifting operation speed. At a convenient time after step 240 generates the proactive action(s), such as when a load is not being supported, the lifting module then prompts a user to conduct the one or more proactive actions generated from step 240.

In the event no deviation from expected lifting parameters is experienced during motor activation, step 242 performs service on the component once the component reaches the servicing position. The service may consist of replacing, altering, cleaning, and measuring various aspects of the component to increase the component's service life and/or operating performance. Once component service has completed, the routine 220 returns to step 224 where the component is lowered from the servicing position. It is contemplated that a single lifting strategy can be utilized while a component is on the drop table, but some embodiments generate a new lifting strategy after component service has been completed to ensure any physical alterations to the component are taken into account and lifting operations have optimal efficiency and safety.

Through the assorted embodiments of a maintenance system, a drop table can ensure the best possible lifting efficiency, safety, and long-term reliability by employing a lifting module. The generation of a lifting strategy based on actual drop table operation and detected component characteristics creates a nearly immediate identification of current and future lifting issues along with reactive actions that can be carried out to correct, prevent, and/or mitigate the performance and safety degradation associated with the lifting issues. By utilizing a closed-loop drop table control, the lifting module can intelligently and automatically receive operational information about the drop table and component being moved, execute the lifting strategy, and conduct actions in response to deviations from lifting parameters expected in the lifting strategy.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present technology to the full extent indicated by the broad general meaning of the terms in which the appended claims are expressed. For example, the particular elements may vary depending on the particular application without departing from the spirit and scope of the present disclosure.

What is claimed is:

1. A method comprising:

connecting a lifting module a first motor, the lifting module comprising a lifting controller, the first motor mechanically coupled to a first lifting column by a first transmission and to a second lifting column by a second transmission;

lowering a service component with the first and second lifting columns by activating the first motor;

detecting a weight of the service component with the lifting module in response to frequency feedback from the first motor; and generating a lifting strategy with the lifting controller in response to the frequency feedback of the first motor, the lifting strategy prescribes operational lifting parameters for the first and second lifting columns to vertically displace the service component with a predetermined sequence of events;

detecting, with the lifting controller, an unexpected deviation from the predetermined sequence of events in response to the frequency feedback of the first motor; and performing, with the lifting controller, at least one alteration to an operational lifting parameter of the first motor in accordance with the lifting strategy to correct the deviation of the predetermined sequence of events.

2. The method of claim 1, wherein the lifting module is connected to a second motor mechanically coupled to a third lifting column via a third transmission and to a fourth column via a fourth transmission.

3. The method of claim 1, wherein the first and second transmissions each comprise a shearing coupling connecting an output shaft of the first motor to a rotating core of the respective lifting columns.

4. The method of claim 1, wherein the first and second lifting columns are each connected to a base and a platform, the base housing the first motor, the platform supporting a service component.

5. The method of claim 4, wherein the base houses a transverse motor connected to a drive line, the first motor configured to provide vertical displacement for the service component, the transverse motor configured to provide horizontal displacement of the service component.

6. The method of claim 4, wherein the service component is a locomotive wheelset.

7. The method of claim 4, wherein the platform supports first and second rail segments each contacting the service component.

8. The method of claim 1, wherein the lifting controller generates the lifting strategy in response to detected operating parameters of the first and second lifting columns.

9. The method of claim 8, wherein the operating parameters are detected via at least one sensor connected to the lifting module.

10. The method of claim 8, wherein the detected operating parameter is a nut gap distance measured between a traveler and a safety nut coupled to a rotating core of the first lifting column.

11. The method of claim 1, wherein the unexpected deviation is detected in response to a variation in amperage of the first motor instead of the frequency feedback.

12. The method of claim 1, wherein an optimization circuitry of the lifting module creates at least one reactive action for the lifting strategy to maintain an operating performance of the respective lifting columns and first motor in response to encountered deviations from lifting parameters expected by the lifting strategy.

13. The method of claim 12, wherein the optimization circuitry creates the at least one reactive action to correct an operating condition predicted by a prediction circuit of the lifting module.

14. The method of claim 12, wherein the at least one reactive action adjusts an operating parameter of the first lifting column while the second lifting column operates unchanged.

15. The method of claim 12, wherein the optimization circuitry generates at least one proactive action for the lifting strategy to prevent an operating condition predicted by a prediction circuit of the lifting module.

16. The method of claim 15, wherein the at least one proactive action increases a grease pressure to the first lifting column while the second column remains unchanged.

17. A method comprising:

connecting a lifting module a first motor, the lifting module comprising a lifting controller, the first motor mechanically coupled to a first lifting column by a first transmission and to a second lifting column by a second transmission;

generating a lifting strategy with the lifting controller, the lifting strategy prescribing operational lifting parameters for the first and second lifting columns to vertically displace the service component with a predetermined center-of-gravity for the service component;

lowering a service component with the first and second lifting columns by activating the first motor;

determining a deviation from the predetermined center-of-gravity with the lifting controller in response to a frequency feedback from the first motor;

executing at least one alteration to an operational lifting parameter of the first motor in accordance with the lifting strategy to correct the deviation of the predetermined center-of-gravity while moving the service component to a servicing position;

detecting a deviation in lifting parameters expected in the lifting strategy; and altering the lifting strategy to correct the detected deviation.

18. The method of claim 17, wherein the deviated lifting parameter is detected via the frequency feedback of the first motor.

19. The method of claim 17, wherein the deviated lifting parameter is correlated to a damaged core thread by the lifting controller.

* * * * *